US011898277B2

(12) United States Patent
Wynne

(10) Patent No.: US 11,898,277 B2
(45) Date of Patent: Feb. 13, 2024

(54) YARN, METHOD AND APPARATUS FOR PRODUCING YARN AND PRODUCTS FORMED THEREFROM

(71) Applicant: TMC Limited, Auckland (NZ)

(72) Inventor: Andrew George Wynne, Levin (NZ)

(73) Assignee: TMC LIMITED, Auckland (NZ)

( * ) Notice: Subject to any disclaimer, the term of this patent is extended or adjusted under 35 U.S.C. 154(b) by 238 days.

(21) Appl. No.: 17/425,795

(22) PCT Filed: Jan. 30, 2020

(86) PCT No.: PCT/NZ2020/050003
§ 371 (c)(1),
(2) Date: Jul. 26, 2021

(87) PCT Pub. No.: WO2020/159387
PCT Pub. Date: Aug. 6, 2020

(65) Prior Publication Data

US 2022/0106712 A1 Apr. 7, 2022

(30) Foreign Application Priority Data

Jan. 30, 2019 (NZ) ..... 750303
Aug. 27, 2019 (NZ) ..... 756477

(51) Int. Cl.
*D02G 3/36* (2006.01)
*D02G 3/04* (2006.01)
*D02G 3/28* (2006.01)

(52) U.S. Cl.
CPC ..... *D02G 3/36* (2013.01); *D02G 3/04* (2013.01); *D02G 3/286* (2013.01); *D10B 2211/02* (2013.01); *D10B 2331/02* (2013.01)

(58) Field of Classification Search
CPC . D02G 3/04; D02G 3/286; D02G 3/36; D10B 2211/02
See application file for complete search history.

(56) References Cited

U.S. PATENT DOCUMENTS 12,467 A * 2/1855 Haslam ..... D02G 3/367 57/12
2,577,793 A 12/1951 Miller
3,153,838 A 10/1964 Marvin et al.
(Continued)

FOREIGN PATENT DOCUMENTS

AU 2609967 A 9/1968
AU 288664 B2 1/1969
(Continued)

OTHER PUBLICATIONS

Kathryn L. Hatch, Textile Science, (1993), West Publishing Company, 1st edition, p. 142 (Year: 1993).*
(Continued)

*Primary Examiner* — Shaun R Hurley
(74) *Attorney, Agent, or Firm* — MERCHANT & GOULD P.C.

(57) ABSTRACT

Yarns include one or more strands, each strand including an outer twisted with a continuous or substantially continuous core, the outer including coarse wool fibres. The coarse wool has average fibre diameter greater than 26 microns. The yarn may be worsted or semi-worsted. Fabrics and/or garments may be produced from the yarn.

23 Claims, 2 Drawing Sheets

(56) References Cited

U.S. PATENT DOCUMENTS

| | | | | | |
|---|---|---|---|---|---|
| 3,443,370 | A | | 5/1969 | Walls | |
| 3,488,939 | A | | 1/1970 | Walls | |
| 3,596,459 | A | | 8/1971 | Wada | |
| 4,186,549 | A | | 2/1980 | Chambley et al. | |
| 4,279,120 | A | | 7/1981 | Norris | |
| 4,495,760 | A | * | 1/1985 | Vanhelle | D02G 3/367 57/12 |
| 4,662,164 | A | | 5/1987 | Morrison | |
| 4,712,365 | A | | 12/1987 | Ferrer | |
| 5,094,068 | A | | 3/1992 | Hirao | |
| 5,243,812 | A | | 9/1993 | Strobel et al. | |
| 5,660,035 | A | | 8/1997 | Musha et al. | |
| 5,706,642 | A | | 1/1998 | Haselwander | |
| 6,311,920 | B1 | | 11/2001 | Jennings et al. | |
| 6,324,872 | B1 | | 12/2001 | Blaszyk et al. | |
| 6,460,322 | B1 | | 10/2002 | Sato et al. | |
| 6,484,962 | B2 | | 11/2002 | Lassmann | |
| 6,655,122 | B2 | | 12/2003 | Shigeyama et al. | |
| 7,882,687 | B2 | * | 2/2011 | Blitstein | D01G 21/00 57/252 |
| 7,913,483 | B2 | * | 3/2011 | Qiu | D02G 3/367 57/18 |
| 8,429,889 | B2 | * | 4/2013 | Lee | B65H 59/385 57/204 |
| 2005/0279075 | A1 | | 12/2005 | Kersey | |
| 2008/0318485 | A1 | * | 12/2008 | Cheng | D02G 3/324 442/182 |
| 2010/0175360 | A1 | * | 7/2010 | Lee | D02G 3/286 57/200 |

FOREIGN PATENT DOCUMENTS

| | | | | | |
|---|---|---|---|---|---|
| AU | 405827 | | | 2/1969 | |
| AU | 455170 | B2 | | 11/1974 | |
| AU | 488616 | B1 | | 10/1976 | |
| CN | 109137197 | A | * | 1/2019 | D02G 3/04 |
| DE | 1685645 | A1 | | 7/1971 | |
| DE | 10032708 | C1 | | 1/2002 | |
| DE | 10025858 | C1 | | 9/2002 | |
| DE | 202004002638 | U1 | | 6/2005 | |
| FR | 1536932 | A | | 9/1968 | |
| JP | S61-83337 | A | | 4/1986 | |
| JP | S61-275428 | A | | 12/1986 | |
| JP | H01-260029 | | | 10/1989 | |
| JP | H04-40778 | A | | 4/1992 | |
| JP | H04108131 | A | | 4/1992 | |
| JP | H04-163331 | A | | 6/1992 | |
| JP | H08-246280 | A | | 9/1996 | |
| JP | 2001115351 | A | * | 4/2001 | D02G 3/324 |
| JP | 2006225827 | A | * | 8/2006 | |
| NZ | 336048 | A | | 1/2001 | |
| WO | 97/30945 | A1 | | 8/1997 | |
| WO | 2004/044290 | A1 | | 5/2004 | |

OTHER PUBLICATIONS

International Search Report for International Application No. PCT/NZ2020/050003 dated Apr. 21, 2020 (5 pages).

International Written Opinion for International Application No. PCT/NZ2020/050003 dated Apr. 21, 2020 (4 pages).

International Preliminary Report on Patentability for International Application No. PCT/NZ2020/050003 dated Dec. 23, 2020 (4 pages).

* cited by examiner

YARN, METHOD AND APPARATUS FOR PRODUCING YARN AND PRODUCTS FORMED THEREFROM

This application is a National Stage Application of PCT/NZ2020/050003, filed 30 Jan. 2020, which claims benefit of Serial No. 750303, filed 30 Jan. 2019 and Serial No. 756477, filed 27 Aug. 2019 in New Zealand and which applications are incorporated herein by reference. To the extent appropriate, a claim of priority is made to each of the above disclosed applications.

FIELD OF INVENTION

The invention relates to yarn, methods and apparatus for producing yarn including coarse wool and fabric and products formed from such yarn.

BACKGROUND

There is an increasing demand for the use of natural fibres due to their desirable properties and to avoid undesirable environmental issues associated with petroleum-based products. Wool has favourable thermal, moisture, wear, slip, odour, anti-bacterial, light reflection and noise absorbing properties. There is demand generally for woollen garments having improved wear characteristics, particularly for use in outdoor equipment and socks.

Coarse wool (also known as crossbred or carpet wool, or in New Zealand as strong wool) when used in this specification refers to wool having a diameter greater than about 26 microns. Coarse wool has generally been considered only to be suitable for low grade applications such as upholstery (better coarse wool grades) and carpet manufacture (lower coarse wool grades). Where attempts have been made to utilise coarse wool in clothing it has been thick and uncomfortable and becomes hairy upon washing. Due to the limited and low value applications for coarse wool it is a relatively low-cost fibre.

Conventional ring frame machines have been used to produce yarn from wool slivers and have been used successfully to process fine wools such as Merino wool with a typical fibre diameter less than 25 microns and lengths less than 90 mmH (millimetres Hauteur, a length measurement used in the industry). Such machines have been unable to process long length fibres (>90 mmH) into fine yarn. The Applicant believes this may be because imparting the required degree of twist for fine yarn formation may tend to cause long, low diameter fibres to break during processing. Also, long fibres may tend to catch simultaneously in the infeed and outfeed rollers of conventional machines. Other problems with controlling the longer fibres may result in large variations in the thickness of the resulting yarn. Coarser carpet yarns may be spun by a woollen spinning process (as opposed to a worsted spinning process) with less twist and coarser, longer fibres.

Whilst products formed from Merino wool are very popular, Merino wool is expensive and not particularly hard wearing. Merino wool is therefore unsuitable for some applications.

The applicant patented a method (referred to herein as the "Nu Yarn method") and an apparatus (referred to herein as the "Nu Yarn machine") for producing a self-twisted yarn as disclosed in NZ552416, NZ522596, U.S. Pat. Nos. 8,429,889B2, 7,752,832B2, WO2004044290A1 and WO2008079025A1, the disclosure of each of which is hereby incorporated by reference into this disclosure. The Nu Yarn machine and method relate to self-twisting yarns and to date have been used with fine wool, such as Merino wool.

To date it has not been considered viable to use coarse wool for the manufacture of fine yarns, light fabrics or high value garments due to processing problems and the perceived unsuitability of coarse wool for such applications. Such high value garments generally have a fabric weight less than 400 g/m$^2$, more typically below 200 g/m$^2$.

It would be desirable to provide fine yarns, fabrics and/or garments or other products based on coarse wool, or at least to provide the public with a useful choice.

SUMMARY OF INVENTION

The applicant has surprisingly found that the Nu Yarn method and machine may be adapted to process coarse wool to produce yarn and products having properties previously unachievable. While this result has been based on the self-twisting Nu Yarn technology, in some aspects of the present invention the yarn may be produced using alternative technology (e.g. adapted ring frame technology) or through new spinning machines. Yarns produced through such alternative technologies are intended to fall within the scope of the claims unless expressly excluded.

Further, the invention is limited to worsted or semi-worsted yarns. Wool spun yarns are not intended to be covered.

In a first aspect there is provided a method of producing a fine yarn from coarse wool slivers using a self-twisting spinning machine. The spinning machine may be a Nu Yarn machine as defined above.

The slivers may be formed of strands of wool having an average fibre diameter greater than 26 microns and a length greater than 100 mmH, or a diameter greater than 30 microns and a length greater than 100 mmH, or a diameter greater than 33 microns and a length greater than 100 mmH, or a diameter greater than 36 microns and a length greater than 100 mmH, or a diameter greater than 36 microns and a length greater than 110 mmH.

The yarn may have a linear density of less than 60 tex (17 Nm), or less than 50 tex (20 Nm), or less than 40 tex (25 Nm), or between 20 tex (50 Nm) to 40 tex (25 Nm).

Prior to spinning the wool may be scoured and/or carded and/or combed and/or super-washed (using a Hercosett process or similar), or otherwise processed as appropriate for worsted or semi-worsted yarns. Such processes are well known in the art.

The yarn may be used to produce fabrics using any suitable process. For example, knitted fabrics may be formed using conventional weft knitting machines. Such fabrics may be used directly or be formed into multi-layer fabrics by lamination or bonding. Water repellent chemical treatments may be applied to the outer fabric layer or a membrane may be provided between the two fabrics to provide water repellent and wind proof performance attributes.

Alternatively, two or more yarns may be interwoven to form a fabric having one layer (or one surface) predominantly formed of coarse wool yarn and another layer (or opposing surface) predominantly formed of another yarn, such as Merino, Tencel, polypropylene or polyester.

Such fabrics preferably have a weight less than 400 g/m$^2$, more preferably below 200 g/m$^2$.

The yarn may also be used to form socks. The yarn may be used solely for the high wear heel and toe regions with other yarn used for other regions.

In a further aspect a worsted or semi-worsted yarn may include one or more strands, each strand including an outer twisted with a continuous or substantially continuous core, the outer including coarse wool fibres.

The yarn may be a worsted yarn.

The yarn may include two or more said strands. The strands may be self-twisted with each other.

The continuous or substantially continuous core may make up at least 15% of the yarn by weight.

The yarn may have a linear density less than 80 tex (12.5 Nm).

In another aspect, a worsted or semi-worsted yarn may be formed from one or more strands each including: at least 15% by weight of a continuous or substantially continuous core; and an outer twisted with the core, the outer including coarse wool fibres.

The yarn may include 15 to 50% by weight of the continuous or substantially continuous core.

In yet a further aspect a yarn of linear density less than 80 tex (12.5 Nm) may include two or more strands, each strand including an outer twisted with a continuous or substantially continuous core, the outer including coarse wool fibres.

The following features may be applied to any of the above aspects. The yarn may have a linear density less than 60 tex (17 Nm). The yarn may have a linear density in the range 25 tex (40 Nm) to 60 tex (17 Nm).

The coarse wool fibres may have average fibre diameter greater than 26 microns. The coarse wool fibres may have average fibre diameter greater than 30 microns. The coarse wool fibres may have average fibre diameter greater than 33 microns. The coarse wool fibres may have average fibre diameter greater than 36 microns.

The coarse wool fibres may have average fibre diameter in the range 30 to 40 microns. The coarse wool fibres may have average fibre diameter in the range 36 to 38 microns.

The coarse wool fibres in wool top may have average fibre length of 100 mmH or greater. The coarse wool fibres in wool top may have average fibre length of 110 mmH or greater. The coarse wool fibres in wool top may have average fibre length in the range 100 to 130 mm H.

The outer may include at least 10% of coarse wool by weight. The outer may include at least 20% of coarse wool by weight. The outer may include at least 30% of coarse wool by weight.

The continuous or substantially continuous core may include at least one synthetic filament. The synthetic filament may have a thickness in the range 10 to 80 Denier. The at least one synthetic filament may be a nylon filament. Alternatively, the at least one synthetic filament may be a polyester filament.

The continuous or substantially continuous core may include at least one filament or thread formed of natural fibres. The thread may have a thickness in the range 10 tex (100 Nm) to 20 tex (50 Nm).

The yarn may be formed of 100% natural fibres.

In another aspect, a fabric may include yarn as described in any of the above aspects. A garment may include such a fabric.

In a further aspect a method for producing a yarn may include: forming two or more twisted strands, each strand being formed by passing a coarse wool sliver and a continuous or substantially continuous core through a reciprocating twisting stage comprising a pair of twist rollers adapted to rotate about an axis of rotation and to move reciprocally along the axis of rotation, each strand having areas of twist separated by areas of non-twist; and bringing the strands together to form the yarn by self-twisting with each other.

In another aspect a method for producing a yarn may include twisting an outer with a continuous or substantially continuous core, the outer including coarse wool fibres.

BRIEF DESCRIPTION OF DRAWINGS

The invention will be described by way of example only, with reference to the accompanying drawings, in which.

DESCRIPTION

Figure 1:
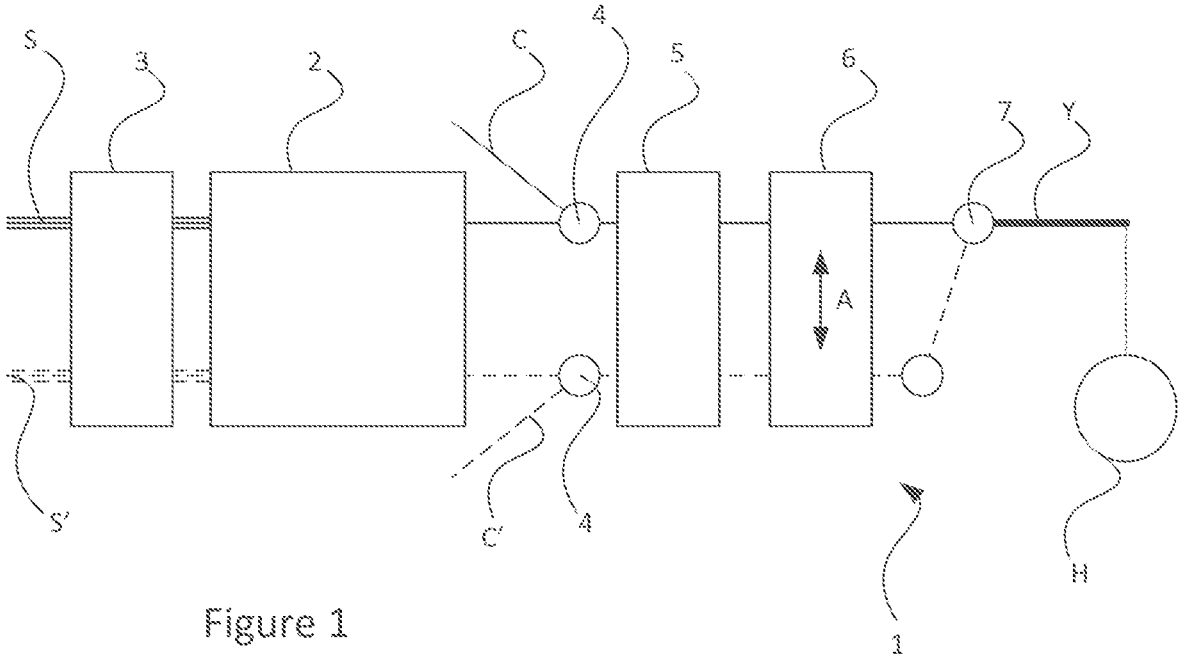
FIG. 1 is a schematic view of a wool spinning apparatus according to one embodiment.

Where reference is made to fibre length in this specification reference is made to mmH (millimeters Hauter which is measured using an almeter as approved by IWTO-17).

The term "continuous or substantially continuous core" as used in this specification and claims includes a continuous or substantially continuous natural or synthetic thread, filament or the like with which an outer including coarse wool fibres is combined to form a strand during yarn production. The core may include a single thread, filament or the like, or may include two or more such threads, filaments or the like.

The term "outer" as used in this specification and claims means fibres that are combined with the core to form a strand during yarn production. The outer includes coarse wool fibres. The terms "outer" and "core" do not necessarily require that the core be wholly contained within the outer in the final yarn, though this may be desirable in some embodiments.

The terms "self-twist yarn" and "self-twisting yarn" as used in this specification and claims means a yarn that comprises two or more strands that have areas of twist in the z-direction alternating with areas of twist in the s-direction, and having areas of non-twist between each area of twist, and where at least one twisted strand is brought into contact with at least one other twisted strand, whereupon the twisted strands self-twist together (wrap around each other) to form a yarn. The term "self-twist" has a corresponding meaning.

The term "strand" as used in this specification and claims is used in its generic sense to include, inter alia, singles strands, plied yarns, spun yarns, and cabled yarns. The strand may be a continuous bundle of filaments, a continuous form of discontinuous filament, a drafted carded sliver, which is untreated or pre-treated to increase its tensile strength, continuous filaments produced by a tow treatment process or a combination of staple fibres, such as spun yarn for example, and one or more continuous filaments.

The measurement terms "Tex" and Nm are used with their standard meanings in the field. Tex is a linear density measured in grams per 1000 meters of yarn. Nm (or number metric) is measured in kilometres per one kilogram of yarn. In general, Tex=1000/Nm.

Coarse wool may be selected to have a diameter (i.e. an average fibre diameter) greater than 26 microns although an average diameter greater than 30 microns or greater than 33 microns or greater than 36 microns may be used. The average diameter may be in the range 26 to 40 microns, or in the range 32 to 40 microns, or in the range 36 to 38 microns.

The coarse wool fibres may have a length (i.e. an average fibre length in wool top) greater than 100 mmH, and the length may be greater than 110 mmH. The length may be in the range 100 to 130 mmH.

The coarse wool is therefore relatively long and coarse. The wool fibres may be relatively straight, or fibres with higher 'crimp' may be used and these may provide improved thermal retention and/or mechanical cushioning.

Prior to spinning the selected wool may undergo a number of pre-processing steps. The wool may be scoured to remove grease, suint and dirt. The wool may then be carded to remove imperfections such as vegetable matter. The wool may be combed to remove short fibres, if required. The wool may then be super-washed, preferably by the Hercosett process or similar, to remove scales and apply a polymer to the wool fibre, resulting in less shrinkage and lower levels of pilling and to render the ultimate product machine washable.

Any other suitable pre-processing of wool may be performed, as appropriate for a worsted or semi-worsted yarn. Such processes are known in the art.

The outer material may be 100% coarse wool. However, blends or other combinations of material may be used in some applications. For example, blends of coarse wool with other fibres may be used. For example, blends (including intimate blends) of coarse wool with synthetic fibres, or other natural fibres, or other wool fibres may be used. Blends of coarse wool and finer wool may be used, such as a 50:50 blend of coarse wool and merino wool. Coarse wool may be present in the outer material at 10 to 100% by weight. The outer material may include at least 10%, or at least 20%, or at least 30% by weight of coarse wool.

In one embodiment the outer may include coarse wool/merino wool blend with greater than 50% coarse wool by weight. For example, the outer may be formed from a blend of coarse wool and merino wool at 90:10 by weight. The coarse wool and merino wool may be blended to provide a blended roving. Any of the ranges of coarse wool and/or merino wool properties disclosed herein may be used, but in one embodiment coarse wool with average fibre diameter in the range 36-38 microns may be used. In general, and without wishing to be bound by theory, the Applicant believes that such a blend provides improved spinning performance and/or improved yarn properties. This is currently believed to be due to the finer and shorter merino wool fibres providing more linking between fibres along the length of the yarn. This in turn may reduce the number of coarse wool fibres that are required to provide adequate yarn structure. Such blends may therefore be suitable for creation of still finer yarns (e.g. around 25 tex in a 2-ply yarn with two 12.5 tex strands, or even finer). The hand feel of the yarn may also be improved. Such a blend may be used with any of the core materials discussed herein.

The core may be a continuous or substantially continuous natural or synthetic thread, filament or the like. As will be discussed below, the outer material is spun and combined with the core to produce a strand. Any suitable core material may be used. Any suitable number and weight of core threads, filaments or the like may be used.

In some applications a core of one or more synthetic filaments may be used. The core may be formed from any suitable synthetic—nylon or polyester or polyamide may be suitable. A synthetic monofilament may be used, such as a nylon monofilament. Alternatively, a synthetic multifilament may be used.

Synthetic core filaments may have a weight of 10 to 80 Denier, though other values may be suitable. In some embodiments, nylon core filaments may be used and may have a weight of 11 to 30 Denier, and any suitable number and weight of filaments may be used in each core. For example, in one application a core may consist of 7 filaments of 11 Denier nylon. In another application a core may consist of 5 filaments of 17 Denier nylon. In other embodiments polyester core filaments may be used and may have a weight of 20 to 80 Denier. In one application a core may consist of 12 filaments of 20 Denier polyester.

In other applications it may be desirable to use a core formed from natural fibres. A natural or non-synthetic spun filament, thread or yarn may be used. For example, a continuous or substantially continuous core of cotton or wool thread/yarn, or other natural fibre may be used. Further, processed natural fibres such as rayon, viscose, lyocell (sold as Tencel) or similar processed core materials based on natural products may be used. Natural core threads may have weights in the range 10 tex (100 Nm)–20 tex (50 Nm), though other values may be suitable in some applications.

Any combination of core materials may be used. For example, a core may include one or more filaments of a first material and one or more filaments of a second material.

In some embodiments the core may make up around 15 to 50% of the yarn by weight.

The selected and pre-processed outer material may be spun and combined with the core using the Nu Yarn machine and Nu Yarn method as defined above. However, other machines may be adapted and other methods used. To avoid entanglement of the slivers two feeders may be employed to maintain separation between strands, although it may be possible to employ a greater number of feeders if greater spacing is provided between feeders or isolation of the slivers from each other is otherwise achieved. In general, any suitable method of providing adequate separation of incoming slivers or strands may be used, for example, any one or more of: increased spacing of the slivers or strands by skipping some inputs (e.g. using every second sliver input); increased spacing of the slivers or strands by increasing the width of the machine and/or the spacing between sliver inputs; and physical separation of slivers or strands, e.g. by including physical separators such as fins, plates etc between incoming slivers or strands.

A faster take up speed of greater than 160 m/min may be used and even greater than 200 m/min may be used. This may result in a significant (e.g. 35%) reduction in energy consumption. This may also reduce the effective machine footprint and cost as each frame processes at 200 m/min compared to a conventional ring frame operating at 14 m/min.

FIG. 1 is a schematic view of a spinning apparatus 1 according to one embodiment. This may be a self-twist spinning machine, such as the NuYarn machine.

The spinning apparatus 1 may include a drafting unit 2. The drafting unit 2 may include opposed moving preferably rubber coated rollers or belts, between which the fibres pass (as slivers). In the example shown, two slivers S (solid line), S' (dashed line) of outer material may be introduced to the drafting unit 2 via feed rollers 3. Each sliver of outer material may be drawn from drums or other bulk supply (not shown). The outer material may include coarse wool in the range 10 to 100% by weight. The outer material may be a blend of any suitable materials with coarse wool.

The outer material fibres are drawn out by the drafting unit, with the thickness of a sliver of outer material typically being reduced to between one half to one twenty-fifth of the initial thickness. The amount of thickness reduction may be adjusted by altering the rotational speed of the drafting unit.

After drafting a core C (solid line), C' (dashed line) may be combined with each sliver of outer material. Each continuous or substantially continuous core may be drawn from a drum, spool or other bulk supply and may be fed, together with the drafted outer material, through a guide 4 (e.g. feed ring or eyelet or other device for bringing the two together).

The core C, C' may be a continuous or substantially continuous core. The core may be any suitable natural or synthetic thread or filament, as discussed elsewhere in this specification.

Figure 2:
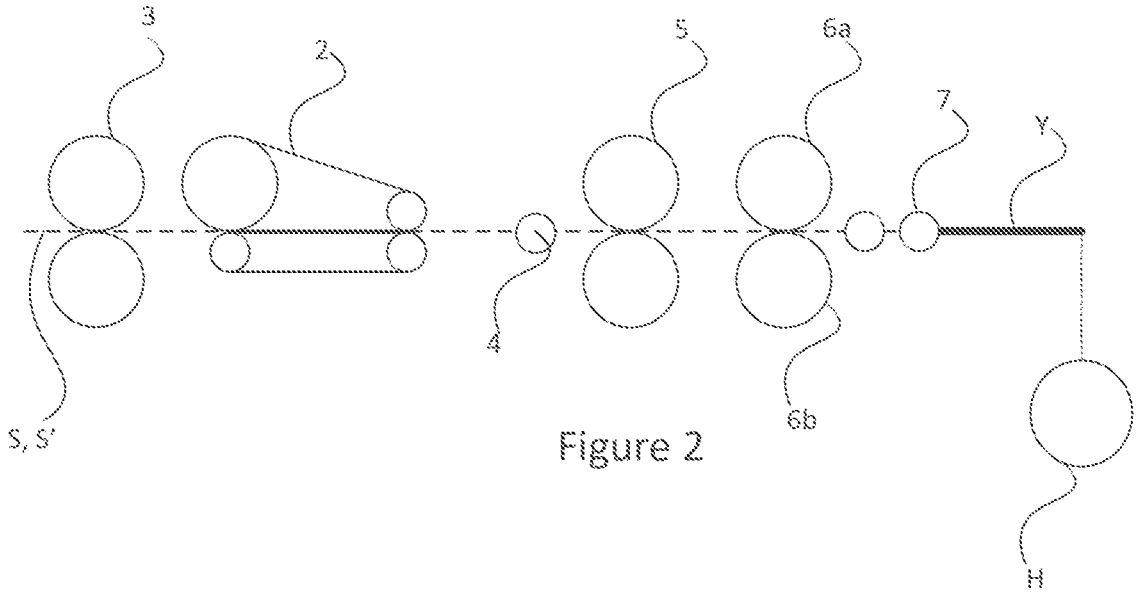
FIG. 2 is a schematic side view of the apparatus of FIG. 1.

The combined outer material S, S' and core C, C' may be passed through further feed rollers 5 to a reciprocating twisting stage 6. As each strand of outer material and core pass through the guide 4 and rollers 5, the core may be pressed into or otherwise combined with the strand or sliver of outer material. The core may be pressed into the middle of the outer material, so that the core becomes surrounded by the fibres of the outer material. The reciprocating twisting stage 6 may include at least one rotating roller 6*a* which also reciprocates back and forth as indicated by arrow A in FIG. 1. That reciprocating roller may be opposed by a fixed element (such as a flat surface), or as shown in FIG. 2 may be opposed by a second rotating roller 6*b*. The second rotating roller may simply rotate, or may also reciprocate along its axis.

The outer material and core pass through and are twisted by the reciprocating twist rollers 6.

The twist rollers 6*a*, 6*b* impart twist to the slivers passing between the rollers in one direction as the roller(s) move(s) one way along its axis, followed by twist in the opposite direction as the roller(s) move(s) the other way along its axis. The length of each area of twist in the slivers S may be controlled (as discussed in the Applicant's prior patents, listed above) by controlling the transverse speed of the oscillating movement of the rollers 6*a* and 6*b* relative to their forward rotational speed. A slow transverse speed relative to a certain forward rotational speed will generate longer areas of twist in the slivers, first in one direction and then the other.

The twisted strands exit the twist rollers 6 and are combined at a guide (e.g. feed ring, eyelet or similar device) 7. The combined strands may self-twist together to form a yarn Y.

The strands may have different path lengths to travel between the twist rollers and the guide 7. As the stands exit the guide 7 they tend to self-twist together, or alternatively, a further twisting mechanism may optionally be provided to assist in twisting the strands together to form the finished yarn. Such a further twisting mechanism may be controlled to enable the extent to which the individual strands are twisted together to be varied i.e. to enable control of the "twist within the twist" of the yarn.

The strands may be twisted with a twist of less than 600 or about 500 cycles (i.e. cycles of twist in one direction and then the other) per meter and most preferably, a twist of between about 250-300 and 400-500 cycles per meter.

Each of the strands may pass over a path of different length relative to the other strands, so that the areas of twist in each of the stands are staggered, or out of phase, relative to one another. In this form of yarn the different path lengths are such that areas of non-twist in each strand are overlaid with areas of twist in other strands in the finished yarn.

In a further embodiment, the apparatus of the invention may be capable of adjusting the position of the guides or eyelets or their mechanical equivalent, which bring the individual strands together, to vary the point of overlap or relative phase of the strands. The adjustment of the guides, or their equivalent, may also be controlled by a microprocessor-based control system of the apparatus.

The yarn Y may then be wound onto a take-up holder H (e.g. a spool or the like), the speed of which may be controlled as discussed in the Applicant's prior patents, listed above. A drive system for the take up holder H may be controlled by a control system such that ratio between the linear speed at which the yarn is wound onto the take up holder and the linear speed at which the strands exit the twist rollers 6 may be controlled. A common control system may control the rotational speed of the twist rollers 6*a* and 6*b* and of the take up holder H. By controlling the rotational speed of the take up holder(s) with the rotational speed of the twist roller(s), the tension imparted on the yarn exiting the twisting stage can be controlled and varied.

The effective circumference of the take up holder and spooled yarn gradually increases as more yarn is wound onto the take up holder H. Thus, if the rotational speed of the take up holder is kept constant, the twisted strands exiting the twist rollers or delivery rollers would be under increasing tension as more yarn is wound onto the take up holder.

It has also been found that environmental factors, such as humidity, can affect the machinery components of prior art spinning machines that are used to impart tension on self-twisting yarns, so that the positive tension imparted on yarns by those machines is inconsistently applied when environmental factors change.

Therefore, as the yarn is wound onto the take up holder 8, the speed at which the take up holder is driven may be controlled, so that the linear speed at which the yarn is wound onto the take up holder is kept constant.

It has been discovered that changing the tension imparted on self-twisting yarns after the twisted strands exit the twist roller(s) changes the twist profile, yarn structure, and properties of the yarn, as disclosed in the Applicant's prior patents, listed above. In particular, it has been found that yarns that are subject to low tension after exiting the twisting stage and before spooling onto the take up holder (low tension yarns, which may be preferred for many applications, where the takeup holder speed is less than a speed at which the strands exit the twist rollers) will have a different yarn structure to yarns that experience positive tension after exiting the twisting stage (high tension yarns, where the takeup holder speed is higher than a speed at which the strands exit the twist rollers).

The resulting yarn preferably has a linear density of less than 80 tex (12 Nm), or less than 60 tex (17 Nm), or less than 50 tex (20 Nm), more preferably less than 40 tex. The yarn may have a linear density in the range 20 tex (50 Nm) to 70 tex (14 Nm), more preferably between 20 tex (50 Nm) to 40 tex (25 Nm).

Fabric may be produced using any suitable process, including e.g. use of a conventional weft knitting machine or another suitable machine. The yarn may be suitable for use in machines have 28 gg (needles per inch) or less. A 180 $g/m^2$ jersey fabric was produced on a 20 gg weft knitting machine.

Fabrics may be knitted or woven uniformly from a yarn produced as set out above. Alternatively, fabrics may be formed (e.g. knitted or woven) from such yarns in combinations with other yarns. For example, a fabric may be knitted such that an outer surface is formed at least predominantly from the yarn containing coarse wool, while an inner surface is formed at least predominantly from merino yarn. The coarse wool provides a hard-wearing outer surface to the resulting garment, while the merino provides good performance against or closer to the skin.

Fabrics produced above may be laminated or bonded to other fabrics or layers. For example, a coarse wool fabric outer layer may be bonded with a range of possible inner layers and may include may include water repellent chemical treatments to the outer (coarse wool) layer or include a membrane between the two fabric layers to provide water repellent and wind proof performance attributes. The coarse wool outer layer provides a hard-wearing outer surface with advantageous low light reflection, excellent tensile properties, excellent abrasion properties, noise absorption, excellent thermal properties, and low odour.

Other fabrics have also been produced using the new yarn, examples of which are:

1. Fleece fabric—coarse wool and Merino—yarn containing coarse wool was knitted to the face (outer) and fine micron Merino (19.5 micron) was knitted to the back (inner). Coarse wool yarn of 25 tex (40 Nm) (with a nylon core) and 30 tex (33 Nm) (polyester core) were knitted to make fleece fabrics in a weight range of between 240 g/m$^2$ and 330 g/m$^2$. It is believed that it should be possible to produce fleece fabrics having a weight below 200 g/m$^2$ using a 28 gg to 20 gg machine.
2. Coarse wool and synthetic—double sided fabrics, such as fleece, may be formed with a coarse wool outer layer and an inner layer formed of Merino wool blended with Tencel or polypropylene or polyester or nylon. Alternatively, the inner layer may be only Tencel or polypropylene or polyester or nylon. The range of fibre types is not restricted to the abovementioned examples.

In general, fabrics including the Applicant's yarn may have weights in the range 185 g/m$^2$ to 500 g/m$^2$. Fabrics including the Applicant's yarn may have weights less than 400 g/m$^2$ or less than 200 g/m$^2$.

Fabrics including coarse wool fibres according to the invention show significant improvements in abrasion resistance. Testing was performed using a Martindale Tester Machine GT-C13B-4 according to testing standards ASTM 4966/4970, IOS 5470, ISO12945-2:2016, ISO 12945-2: 2000. Samples of the Applicant's fabrics showed abrasion ratings in the range 3.81 to 4.67, compared to around 3.75 expected for synthetics and around mid 2's for merino.

Socks produced using the new coarse wool yarn exhibit extremely high abrasion resistance with up to 3 times greater longevity. Testing of socks produced using the new coarse wool yarn achieved a 4.89 out of 5 abrasion resistance score (compared to a typical 3.75 for synthetics and mid 2's for Merino). Testing was performed using a Martindale Tester Machine GT-C13B-4 according to testing standards ASTM 4966/4970, IOS 5470, ISO12945-2:2016, ISO 12945-2: 2000.

The socks also exhibit greatly improved non-slip characteristics.

The new coarse wool yarn may be used only in the high wear heel and toe areas with no Nylon reinforcing and may be knitted on a hosiery knitting machine 36 gg 156 needle, 3¾". The remainder of the sock may be formed of a Terry loop 19.5 to 24 micron Merino inner (providing comfortable fine micron wool next to skin) and a plated nylon outer (nylon reinforcing to overcome the degradation of Merino wool) with a tex range of 16 tex (62 Nm) to 60 tex (17 Nm).

In general, any garment may include some regions using the Applicant's yarns including coarse wool and other regions formed from other yarns.

Garments formed using the new coarse wool yarn may include outerwear and outdoor garments including tops, pants and socks and may exhibit any one or more of the following desirable characteristics:

- hard wearing outer surfaces with excellent abrasion properties
- excellent thermal properties
- excellent tensile properties
- low light reflection
- noise absorption
- less slip than synthetics when used in socks—as the nylon gets wet and starts to slip in the heel and toe of the shoe or boot
- low odour
- environmentally friendly—non-petroleum based
- less moisture
- lower bacterial count Any suitable drive and control arrangements may be used for driving and/or controlling motion of the various rollers, drafting stage, take up holder etc, including the arrangements described in the Applicant's prior patents listed above. Any of the following, and any other suitable parameters of the machine, may be controlled where a self-twisting machine is used.

Areas of non-twist may be found in the strands at the point at which the roller(s) change(s) direction. If the rollers change direction relatively quickly at each end of their transverse reciprocal movement then there will be only a relatively small area of non-twist between each area of opposite twist, whereas by causing the rollers to change direction relatively slowly at or towards the end of their transverse movements, or pause, relatively longer areas of non-twist will be formed in the slivers.

The extent of the transverse reciprocating movement or throw of the rollers 6*a* and 6*b* may also be varied relative to their forward rotational speed to achieve the desired degree of twist in the strands or twist profile of the yarn. Additionally or alternatively the desired degree of twist may be obtained by varying the rotational speed of the twist rollers 6*a* and 6*b*. Additionally or alternatively again the degree of twist or twist profile may be varied by adjusting the speed of reciprocating the transverse movement of the twist roller(s) (relative to their rotational speed).

Any one or more but preferably all of the variation in the speed of transverse movement and/or extent or throw and/or rotational speed of the twist roller(s) and/or uptake speed may be controlled by a microprocessor-based control system having an associated user interface. A user may programme into the machine any desired roller speed, extent of roller transverse movement, rate of roller transverse movement, uptake speed, or a combination of all of these, for any production run to achieve a desired twist profile in the strands or resulting multi-ply yarns.

Yarns produced with different roller speeds and movement may have different properties, and may in turn produce fabrics with different properties or knitted or woven products formed from the yarns with different properties, suitable for different end applications.

Figure 3:
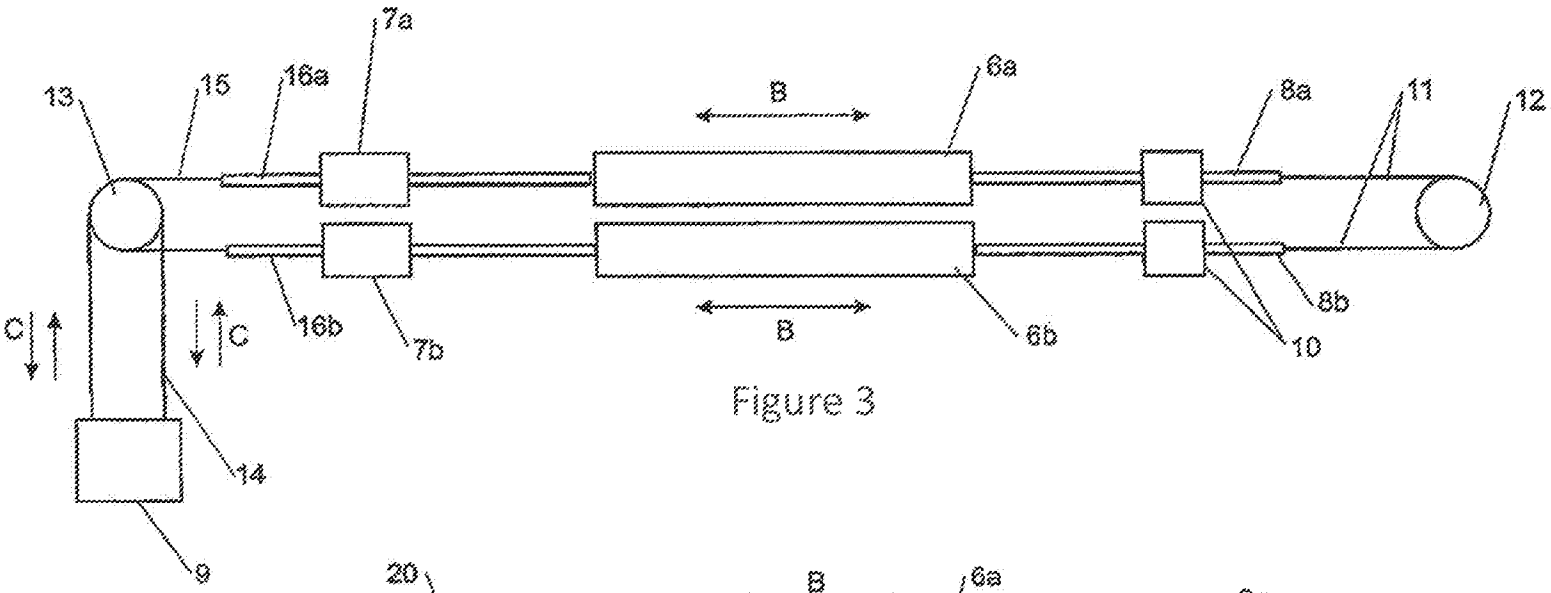
FIG. 3 shows one embodiment of twist roller drive mechanism.
Figure 4:
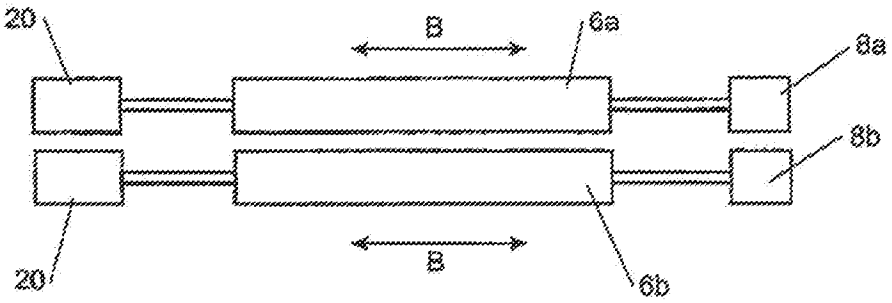
FIG. 4 shows a further embodiment of twist roller drive mechanism.

FIGS. 3 and 4 show examples of an arrangement for driving the twist rollers, similar to those in the Applicant's prior patents listed above.

In the arrangement shown in FIG. 3, electric motors 7*a* and 7*b* drive rotation of the twist rollers 6*a* and 6*b*. The rotational speed of rollers 6*a* and 6*b* may be varied by varying the speed of the electric motors 7*a* and 7*b* or by any other suitable mechanism. The roller drive motors may be controlled by a suitable controller, such as a user programmable microprocessor-based control system. An electric motor 9, such as a servomotor, may drive the reciprocal movement of the twist rollers 6*a* and 6*b*, and may be controlled to vary the speed and/or extent of reciprocal transverse movement of the twist rollers. Servomotor 9 or gear drives a pulley or sprocket (not shown) which rotates and counter rotates and is connected to cable or chain 14 which extends about pulley or gear 13. Cable or chain 15 also extends about pulley or gear 13 and is connected at one end to shaft 16*a* and at the other end to shaft 16*b*, via swivels or similar. Rotation and then counter rotation of the output of the motor 9 drives the cable 15 as indicated by arrows C and thus the twist rollers 6*a* and 6*b* back and forth with a reciprocal movement. That is, movement of cable or chain 14 in an anti-clockwise direction by servomotor 9 will cause cable or chain 15 to move in an anti-clockwise direction and roller 6*a* to move transversely in one direction and roller 6*b* to move transversely in the opposite direction, as both rollers rotate, and vice versa when servomotor 9 reverses its direction. The twist roller shafts 8*a* and 8*b* attach to cable or chain 11 at their other ends, which passes about pulley or gear 12, via swivels or similar.

The rollers 6*a* and 6*b* may be mounted for rotational movement and reciprocating side movement by the roller shafts 8*a* and 8*b* passing through slide bearings 10 on one or both sides (shown on one side only—the right hand side of FIG. 5A) or similar. The roller shafts 8*a* and 8*b* may pass slidingly through electric motors 7*a* and 7*b* which drive the rollers while also allowing for the sideways reciprocal movement of the rollers/roller drive shafts. Alternatively, telescopic couplings may be provided between the roller drive shafts and the rotational drive motors 7*a* and 7*b*.

Variation in the throw and/or rotational speed of the twist rollers may be achieved without the use of servomotors by using other suitable equivalent mechanical or electro-mechanical means. FIG. 4 shows an alternative drive system for twist rollers 6*a* and 6*b*. In this case, the rollers are each both caused to rotate and move transversely by electric motors 20 which not only rotate an output drive shaft but also move their output drive shafts axially as they rotate. The rotational speed and extent of axial or transverse movement of each of the motors 20 may be programmably controlled by the control system of the machine.

In further embodiments, additional rollers, drafting stages and/or twist rollers may be used, as disclosed e.g. in the Applicant's prior patents, listed above.

Most preferably machines of the invention may include a control system which enables programmably variable rotational speed of the twist rollers, speed of transverse movement of the twist rollers, and extent of transverse movement of the twist rollers, or multiple pairs of twist rollers. Yarns having a wide range of different twist properties may be produced on one such machine, which in turn enables production of fabrics or knitted or woven products formed from the yarns which have a wide range of different fabric or product properties, for different fabric or product applications; Yarns may be engineered to optimise desired performance characteristics of the fabrics or products produced from the yarns. Varying the twist level along the length of the yarns may enable optimising of the bulk or strength of the yarn. The exposed surface of the component fibres may be altered with different twist properties to more effectively optimise specific physical properties such as for example the ability of the wool to absorb and desorb moisture or moisture vapour. Fibre shedding and/or pilling may be reduced by twisting briefly tightly at intervals less than the staple length of the component fibres. The shock absorption properties of a terry sole structure in socks may be improved. The ability to adjust the juxtapositioning of different twist (or non-twist) levels between component yarns may enable increased, or optimising of, the friction between the component yarns to increase the strength of the multi-ply yarn, and may enable a particular desired surface appearance of the resulting yarn to be achieved or varied. Where a core filament is also incorporated into the yarn this enables a further degree of variability. It may enable a reduction of the twist level necessary to give a multi-ply yarn incorporating the core filament sufficient strength to enable it to be knitted or woven so that for a given weight of yarn the bulk or exposed fibre surface area may be increased. For example multi-ply yarn for use in producing a high quality lightweight knit fabric of wool may be produced so as to have in the individual slivers or strands relatively long areas of twist, in which the degree of twist is low, and shorter areas of non-twist with incorporation into the yarn of a continuous core filament as previously described. Yarn for use in producing terry fabrics may be produced so as to have short areas of medium twist between longer areas of non-twist in the strands of the yarn, and may also incorporate a core filament (to produce the longer areas of non-twist the transverse reciprocal movement of the twist rollers may slow or stop—while forward rotation of the rollers continues—at either end of the transverse roller movement, & the machine may be programmed to move the rollers relatively quickly when they do move transversely, to reduce the length of the twisted areas, during which the forward rotational movement of the rollers may optionally slow for example). For yarns to be used in the production of felted fabrics from coarser wool short areas of twist may be formed between longer areas of non-twist to facilitate matting of fibres in the non-twist areas of yarns forming the fabric with each other in the felting process.

There is thus provided a method of using inexpensive coarse wool fibre to produce high value products having superior characteristics to existing products. Surprisingly, such high value yarns, fabrics and garments may be based on inexpensive coarse wool fibres that generally have been considered only to be suitable for low grade applications such as carpet manufacture.

Higher wool contents are possible in garments with the substitution of coarse wool fabrics for synthetic fabrics (e.g. 75% wool in socks). Fabrics produced may be at least 50%, or 60% or 80% wool. In some applications 100% wool or 100% natural fibre fabrics may be created.

The longer coarse wool fibres run better and faster in the machine, improving efficiency and reducing equipment and manufacturing costs.

Resulting products have a good appearance with less pilling as there are many fewer short fibres. Fabrics produced using the coarse wool yarn have been assessed as having a pilling grade of 4 (slight pilling) instead of 3 (distinct fuzzing) for shorter fibres.

While the present invention has been illustrated by the description of the embodiments thereof, and while the embodiments have been described in detail, it is not the intention of the Applicant to restrict or in any way limit the scope of the appended claims to such detail. Further, the above embodiments may be implemented individually, or may be combined where compatible. Additional advantages and modifications, including combinations of the above embodiments, will readily appear to those skilled in the art.

Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A worsted or semi-worsted yarn of linear density less than 80 tex, including one or more strands, each strand including an outer material twisted with a continuous core, the outer material including coarse wool fibers, wherein the coarse wool fibers have an average fiber diameter greater than 26 microns.

2. A yarn as claimed in claim 1, being a worsted yarn.

3. A yarn as claimed in claim 1, including two or more said strands.

4. A yarn as claimed in claim 3, the strands being self-twisted with each other.

5. A yarn as claimed in claim 4 wherein the two or more strands have areas of twist in a z-direction alternating with areas of twist in a s-direction, and having areas of non-twist between each area of twist.

6. A yarn as claimed in claim 1, wherein the continuous core makes up at least 15% of the yarn by weight.

7. A yarn as claimed in claim 1, having a linear density less than 60 tex.

8. A yarn as claimed in claim 1, having a linear density in the range 25 to 60 tex.

9. A yarn as claimed in claim 1, wherein the coarse wool fibers have average fiber diameter greater than 30 microns.

10. A yarn as claimed in claim 9 wherein the coarse wool fibers have average fiber diameter in the range 30 to 40 microns.

11. A yarn as claimed in claim 1, wherein the coarse wool fibers in wool top have average fiber length of 100 mmH or greater.

12. A yarn as claimed in claim 1, wherein the coarse wool fibers in wool top have average fiber length of 110 mmH or greater.

13. A worsted or semi-worsted yarn formed from one or more strands each including:

at least 15% by weight of a continuous core; and an outer material twisted with the core, the outer material including coarse wool fibers, wherein the coarse wool fibers have an average fiber diameter greater than 26 microns.

14. A yarn as claimed in claim 13, including 15 to 50% by weight of the continuous core.

15. A yarn of linear density less than 80 tex, the yarn including two or more strands, each strand including an outer material twisted with a continuous core, the outer material including coarse wool fibers, wherein the coarse wool fibers have an average fiber diameter greater than 26 microns.

16. A yarn as claimed in claim 1, wherein the outer material includes at least 10% of coarse wool by weight.

17. A yarn as claimed in claim 1, wherein the outer material includes at least 20% of coarse wool by weight.

18. A yarn as claimed in claim 1, wherein the continuous core includes at least one synthetic filament.

19. A yarn as claimed in claim 18 wherein the synthetic filament has a linear density in the range 10 to 80 Denier.

20. A yarn as claimed in claim 18 wherein the at least one synthetic filament is a nylon filament.

21. A yarn as claimed in claim 1 wherein the continuous core includes at least one filament or thread formed of natural fiber.

22. A yarn as claimed in claim 21 wherein the thread has a linear density in the range 10 to 20 tex.

23. A yarn as claimed in claim 21, formed of 100% natural fibers.

* * * * *